United States Patent [19]

Gutter et al.

[11] Patent Number: 4,696,908

[45] Date of Patent: Sep. 29, 1987

[54] INSULATION DISPLACING GROUND STRAP

[75] Inventors: David H. Gutter; Walter C. Shatto, Jr., both of Harrisburg, Pa.

[73] Assignee: AMP Incorporated, Harrisburg, Pa.

[21] Appl. No.: 918,432

[22] Filed: Oct. 10, 1986

[51] Int. Cl.[4] ..... H01R 4/66

[52] U.S. Cl. ..... 439/98; 439/394; 439/420

[58] Field of Search ..... 339/14 R, 97 R, 14 L, 339/251; 179/76

[56] References Cited

U.S. PATENT DOCUMENTS

| | | | |
|---|---|---|---|
| 3,452,318 | 6/1969 | Tanges | 339/97 |
| 3,897,127 | 7/1975 | Haitmanek | 339/14 R X |
| 4,120,554 | 10/1978 | Bianchi et al. . | |
| 4,310,209 | 1/1982 | Fleming et al. | 339/97 R X |

FOREIGN PATENT DOCUMENTS

| | | | |
|---|---|---|---|
| 1067556 | 1/1984 | U.S.S.R. | 339/97 R |

*Primary Examiner*—Eugene F. Desmond

*Attorney, Agent, or Firm*—Harrisburg, PA 17105

[57] ABSTRACT

A grounding strap 10 for terminating the outer conductor 24 of an electrical cable. The grounding strap can include a plurality of outwardly convex surface portions 17 between adjacent pairs of prongs 16 which are flattened upon clamping of the strap 10 to the cable, causing the prongs 16*a*, 16*b* of each pair 16 to turn toward one another to retain the outer conductor 24 firmly therebetween. The grounding strap 10 is preferably cut to any desired length from a strip of continuous length for mounting to cables of any diameter, and does not require cutting of the cable or other initial preparation of the cable.

11 Claims, 4 Drawing Figures

INSULATION DISPLACING GROUND STRAP

BACKGROUND OF THE INVENTION

The present invention relates to a method and apparatus for terminating electrical cables and, more particularly, to a grounding strap for terminating the outer shielding conductor of an electrical cable, to a method of mounting a grounding strap to a cable, and to a method of manufacturing grounding straps.

Shielded electrical cables having one or a plurality of signal-carrying center conductors surrounded by one or more tubular-shaped, braided outer conductors are used in applications wherein shielding is desired to reduce electromagnetic interference of the signals transmitted by the cable. Shielded cables are often used to transmit signals from remote locations to processing circuitry located within a housing or other enclosure; and, in such applications, it is desirable to dissipate the noise carried on the outer shielding conductor the cable prior to entrance of the cable into the housing and into the circuitry, as any noise present on the outer conductor can interfere with the electronics in the circuitry. Power cables also frequently include an outer conductor coaxially encompassing other conductors of the cable to provide a protective ground.

Various devices have been used to ground the outer shielding conductor of a cable. Many prior devices were not satisfactory because it was necessary to cut through the cable or to otherwise prepare the cable for receipt of the grounding structure.

In one known grounding device, the braided outer conductor of a cable was grounded by electrically conductive contact tips or prongs extended through the outer jacket of the cable into contact with the outer conductor. The prongs were mounted on or affixed to an external grounding structure to provide a grounding path from the prongs to external ground to dissipate noise carried by the outer conductor.

In another known grounding device, a pair of contact prongs is mounted on a deformable support plate so that the prongs are embedded within the cable by pressing the plate and cable together. The support plate bends to conform to the curvature of the cable, causing the embedded tips of the prongs to turn toward one another to grab and retain the braided conductor therebetween.

Such known devices have not been fully satisfactory. In such devices, only a few prongs were inserted into the cable, and the inserted prongs were disposed in such a manner that the outer conductor was not reliably grounded. In many such devices also, it was necessary to manufacture the grounding structure in a variety of sizes to terminate cables of different diameter.

SUMMARY OF THE INVENTION

The present invention provides apparatus for terminating the outer conductor of a cable which comprises an electrically conductive strap adapted to be positioned around the circumference of a cable to be terminated. The strap has a plurality of electrically conductive contacts extending inwardly therefrom and positioned to extend into the cable to reliably contact the outer conductor of the cable when the strap is mounted to the cable. The mounted strap can be connected to suitable external grounding structure to provide a grounding path to dissipate noise carried on the outer conductor.

In a preferred embodiment of the invention, the strap comprises a narrow strip of flexible, electrically conductive metal which is manufactured as a continuous strip in a conventional stamping press. A plurality of integral contact prongs which are spaced along the length of the strap extends outwardly therefrom in a direction substantially perpendicular to one surface thereof. The prongs are arranged in pairs, and the opposite surface of the strap is formed with convex surface portions between adjacent pairs of prongs.

To terminate the outer conductor of a cable, a length of strap that is substantially equal to the circumference of the cable to be terminated is first cut from the continuous metal strip. The cut strap is then positioned around the cable and clamped in place by a suitable clamping mechanism. As the clamp is tightened, the prongs are pushed through the outer jacket of the cable and into and through the braided outer conductor. As the clamp is further tightened, the clamp tends to cause the convex surface portions of the strap to flatten out and cause the two prongs in each prong pair to turn toward one another such that their tips grab the braided outer conductor and retain it firmly therebetween.

The opposite surface of the strap also includes concave surface portions between each prong in a prong pair to help guide and turn the prongs toward one another as the clamp is tightened. After the strap is fully mounted to the cable, the clamp is removed, and the mounted strap can be connected to a housing or other external grounding structure to provide a grounding path from the outer conductor to external ground. After the clamp has been removed, the stored energy in the partially flattened curved portions of the strap tend to maintain the prongs together to firmly retain the outer conductor therebetween and to retain the strap on the cable.

With the present invention, termination of the outer conductor of a cable requires no preliminary cable preparation. The strap can be mounted to the cable at any location along its length without disruption of service and without cutting into the cable.

In manufacturing the strap, a continuous strip of an electrically conductive material having a sufficient hardness to pierce the insulating jacket of a cable is formed to provide a relatively narrow strip with pointed protrusions that project generally at right angles from a longitudinal surface of the strap. The strap is preferably also shaped to drive the protrusions into the cover and to rotate the protrusions to engage the outer conductor. By manufacturing the strap as a continuous strip, it can simply be cut to any desired length for use. A strap, therefore, can be easily sized to fit any cable, and an inventory of termination devices to accommodate cables of varying diameter is not necessary.

Further advantages and specific details of the invention will be set forth hereinafter in conjunction with the following detailed description of a presently preferred embodiment.

DETAILED DESCRIPTION OF THE PREFERRED EMBODIMENT

Figure 1:
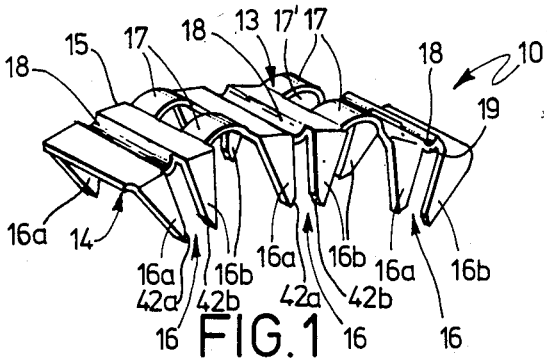
FIG. 1 illustrates a section of a cable termination strap according to a presently preferred embodiment of the invention.

FIG. 1 illustrates a section of a cable termination strap according to a preferred embodiment of the invention. The strap is generally designated by reference numeral 10 and comprises a narrow band of an electrically conductive, flexible and resilient metal such a plated hardened steel or other resilient conductive metals. As will be explained hereinafter, strap 10 is preferably formed from a continuous strip of metal which is manufactured in a conventional stamping press in a manner well-known to those skilled in the art.

Strap 10 includes an upper surface 13 and a lower surface 14. A plurality of pointed contact tips or prongs 16*a* and 16*b* is formed integral with strap 10 and extends downwardly along both edges 15 and 19 of the strap in a direction generally perpendicular to lower surface 14 of the strap. Prongs 16*a* and 16*b* preferably extend along the entire length of the strap 10. As shown in FIG. 1, prongs 16*a* and 16*b* are arranged in pairs with one prong 16*a* and one prong 16*b* defining a prong pair 16. The prongs 16*a* and 16*b* are formed with a length sufficient to extend through the outer cable insulation to the outer conductor of the cable, but insufficient to reach the conductors carried within the outer conductor of the cable.

Each pair of prongs 16 along an edge of the strap 10 is spaced from the adjacent pair of prongs by a first bifurcated strap portion 17 which is curved to define an upwardly facing convex surface and a downwardly facing concave surface as shown in FIG. 1. Slots 41 extend through respective convex surfaces of strap portion 17. The slots 41 are in a plane outwardly spaced away from a plane of the strap portion 18. In addition, each of the prongs 16*a* and 16*b* which comprise a prong pair 16 is spaced laterally across the strap 10 from another prong pair 16 by a non-bifurcated second strap portion 18 which is curved to have a downwardly facing convex surface and an upwardly facing concave surface. As is apparent from the figures, first curved portions 17 are larger than second curved portions 18 so that the spacing between each prong pair 16 is greater than the spacing between the prongs 16*a* and 16*b* in a prong pair.

Figure 2:
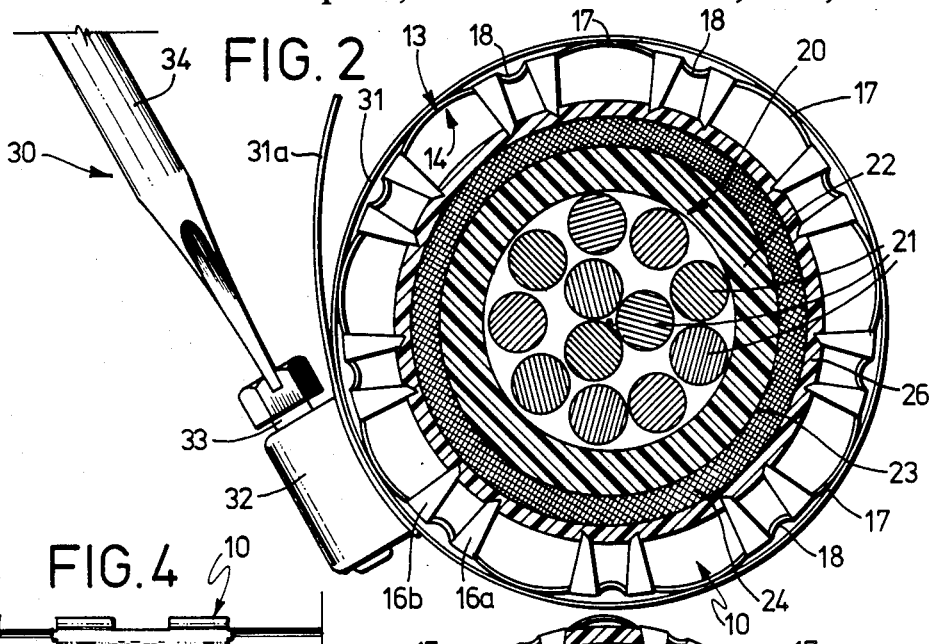
FIG. 2 is a cross-sectional view illustrating the cable termination strap of FIG. 1 in the process of being mounted to a cable.
Figure 4:
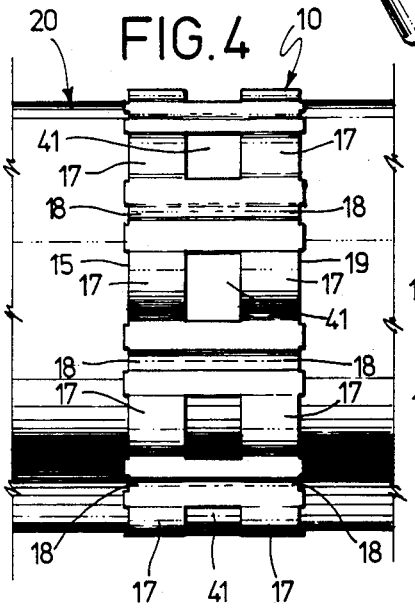
FIG. 4 is a side view of the terminated cable of FIG. 3.

FIG. 2 illustrates a cable 20 having strap 10 positioned therearound. Strap 10 is preferably cut from the continuous strip of metal to a length substantially equal to the circumference of the cable 20 to be terminated so that it will extend fully around the cable when installed thereon.

Cable 20 comprises a plurality of discrete center wires 21 surrounded by a buffer layer 22, a spiral wrap layer 23, an outer conductor 24, and a jacket 26. Cable 20 is intended to be exemplary only of shielded cable constructions. The cable termination strap of the present invention may be used to terminate coaxial and triaxial cables of numerous forms, and the described example of its application is not intended to limit the invention to any particular cable construction.

Outer conductor 24 comprises a tubular, braided conductor which surrounds the center wires 21. Outer conductor 24 functions as an electromagnetic shield to reduce electromagnetic coupling between the signals carried by the center wires 21 and the surrounding environment. Termination strap 10 provides a ground connection from the outer conductor 24 to an external ground. Termination strap 10 can be used, for example, to dissipate the noise carried on the outer conductor of a triaxial cable. By using such termination strap, the noise on the outer conductor of a triaxial cable can be dissipated prior to entry of the cable into a housing for signal-processing circuitry. Such termination straps can also be used to provide a protective electrical ground on power cables.

As shown in FIG. 2, strap 10 is positioned around the circumference of cable 20 such that lower surface 14 thereof faces the outer jacket 25 of the cable, and the prongs 16a and 16b extend inwardly toward the cable. Strap 10 is then clamped in place by any suitable clamping apparatus.

Figure 3:
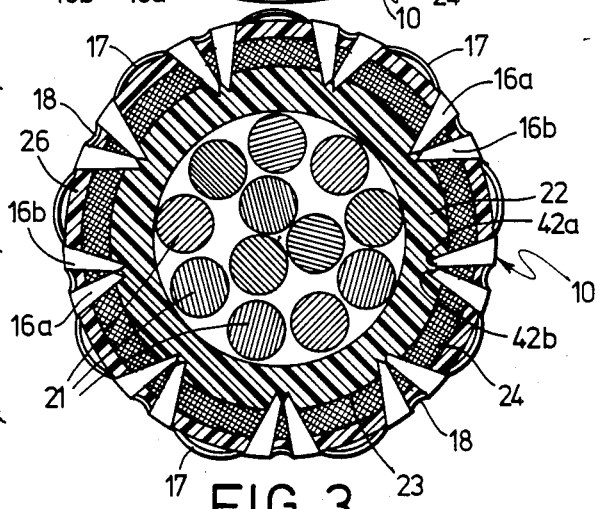
FIG. 3 is a cross-sectional view illustrating the cable-termination strap of FIG. 1 mounted to a cable.

One suitable clamping apparatus is illustrated schematically at 30 in FIG. 2. Clamping apparatus 30 is similar to a conventional hose clamp and comprises a screw carrier 32, a screw 33 and a band 31 having a plurality of space slots extending transversely thereacross along its length and adapted to provide a thread-like engagement with the screw 33. One end of the band 31 is attached to the screw carrier. The band is wound around the cable on top of the strap 10, and the free end 31a of band 31 is threaded through the screw carrier 32. A shaft of screw 33 extends into the screw carrier 32 and is rotatably mounted therein. Upon rotation of screw 33 in one direction by a screwdriver 34 or the like, the threads on the screw engage th slots in the band 31 and tighten the band 31 around the strap 10. As the clamp 30 is tightened, the width of the clamp 30 will fit into and along the slots 41 aligned longitudinally of the strap 10. The clamp 30 will bridge across each strap portion 18 and urge evenly against the two pairs of prongs 16 of each strap portion 18. The contact prongs 16*a* and 16*b* will be pushed through the outer jacket 26 of the cable and into and through the braided outer conductor 24. When the band 31 bottoms on the strap 10, further tightening of the clamp will cause the upwardly convex first surface portions 17 on the strap to flatten out. As surface portions 17 flatten, the prongs 16*a* and 16*b* of each prong pair 16 will rotate or turn toward one another unitl their tips touch as shown in FIG. 3. The prongs 16*a* and 16*b* of each prong pair will securely engage and hold the braided outer conductor 24 therebetween. Downwardly convex second surface portions 18 between each prong in the prong pairs 16 act somewhat as a pivot mechanism to ensure that the prongs will turn toward one another as the clamp is tightened.

As best shown in FIGS. 1, 2 and 3, the tips of the prongs 16*a* and 16*b* are cut in a manner to define facing edges 42*a* and 42*b*, respectively. When the tips of two prongs in a prong pair come together, the edges 42*a* and 42*b* will come together at a point to help retain the braided conductor therebetween.

After the band 31 has been fully tightened and the strap section 10 is in the position shown in FIG. 3, the clamp 30 can be loosened and removed (by rotating screw 33 in the opposite direction). As can be seen in FIG. 3, the first and second strap portions 17 and 18 are not fully flattened out, but remain somewhat curved. Although band 31 tends to flatten the strap 10 during its installation, flattening of portions 17 and 18 is opposed by the reduction in diameter of the strap as the prongs are pressed into the cable. The spring-like action of curved portions 17 and 18 and the energy stored within portions 17 and 18 as a result of the flattening help to maintain the contact prongs 16*a* and 16*b* firmly together and to retain the strap reliably on the cable. Once installed, the strap 10 can be connected to an external grounding structure as is well known in the art to provide a grounding path from the outer conductor.

The cable termination strap 10 of the present invention can be mounted to a cable at any position along its length without any cable preparation being necessary and without it being necessary to cut through the cable. By manufacturing strap 10 as a continuous strap, the strap can be rolled up on a spool or the like for storage and cut to any desired length for use on cables of all diameters. The strap can be formed in any suitable width, but preferably has a width of less than about an inch.

As shown in FIG. 1, the strap 10 can be formed from a single, continuous conductor strip. The strap 10 can be stamped or otherwise formed to provide the pointed protrusions 16*a* and 16*b* extending generally at right angles from a longitudinal surface 14 of the strip. The strip can also be formed to provide a plurality of strap portions including protrusions adjacent each end and a surface portion 17 therebetween adapted to drive the protrusions into the insulating cable covering 23 as shown in FIG. 2 and to rotate them as shown in FIG. 3 so that they engage the outer coaxial cable conductor 24. The strip can be provided with pivot means 18 between each of the plurality of cable portions as, for example, by shaping the strip between the adjoining protrusions to rotate the protrusion of adjoining strap portions toward each other, and preferably into engagement, thereby defining protrusion pairs 16.

While what has been described constitutes a presently preferred embodiment, it should be understood that the invention could take various other forms. For example, the strap 10 could be wrapped around a cable in a spiral fashion if desired, or mounted to a cable at several different locations therealong. Also, the prongs can be positioned on the strap or spaced from one another in ways other than shown herein without departing from the invention. Because the invention can take other forms, it should be understood that the invention is to be limited only insofar as is required by the scope of the following claims.

We claim:

1. A grounding strap for terminating an outer conductor of an electrical cable, comprising:

an elongated conductive strip having a thickness bent into first bowed portions and second bowed portions, a plurality of prongs along said strip and projecting outwardly in a common direction from said thickness of said strip, said strip being deformable into a curved configuration around an electrical cable with said prongs extending toward an outer conductor of said cable to engage conductively said outer conductor upon compression of said strip around said cable.

said first bowed portions of said strip being spaced apart from each other along said strip and positioned between corresponding adjacent said prongs, said first bowed portions of said strip projecting in the same direction as said prongs to engage said electrical cable upon compression of said strip around said cable.

and, said second bowed portions of said strip being spaced apart from each other along said strip, said second bowed portions projecting outwardly away from said first bowed portions for receiving the application of compression against said strip to result in said compression of said strip around said cable.

2. A grounding strap as recited in claim 1, and further including; slots extending through corresponding said second bowed portions, and said slots being elongated along said elongated strip.

3. A grounding strap as recited in claim 1, wherein; said first bowed portions are deformable from bowed configurations toward flattened configurations upon engagement with said electrical cable, and said corresponding adjacent said prongs are pivotable toward each other upon deformation of said first bowed portions toward said flattened configurations.

4. A grounding strap as recited in claim 1, wherein; said strip has opposite first and second longitudinal edges, each of said first bowed portions extends from said first longitudinal edge to the second longitudinal edge, and said prongs are along both said first and said second longitudinal edges.

5. A grounding strap as recited in claim 1, wherein; said prongs are bent outwardly from said thickness of said strip.

6. A grounding strap as recited in claim 2, wherein; said first bowed portions are deformable from bowed configurations toward flattened configurations upon engagement with said electrical cable, and said corresponding adjacent said prongs are pivotable toward each other upon deformation of said first bowed portions toward said flattened configurations.

7. A grounding strap as recited in claim 2, wherein; said strip has opposite first and second longitudinal edges, each of said first bowed portions extends from said first longitudinal edge to the second longitudinal edge, and said prongs are along both said first and said second longitudinal edges.

8. A grounding strap as recited in claim 3, wherein; said strip has opposite first and second longitudinal edges each of said first bowed portions extends from said first longitudinal edge to the second longitudinal edge, and said prongs are along both said first and said second longitudinal edges.

9. A grounding strap as recited in claim 2, wherein; said prongs are bent outwardly from said thickness of said strip.

10. A grounding strap as recited in claim 3, wherein; said prongs are bent outwardly from said thickness of said strip.

11. A grounding strap as recited in claim 4, wherein; said prongs are bent outwardly from said thickness of said strip.

* * * * *